United States Patent [19]

Herst et al.

[11] 4,420,798

[45] Dec. 13, 1983

[54] ADJUSTABLE OVERHEAD LIGHTING SYSTEM

[75] Inventors: Douglas J. Herst, Ross; Henry H. Iwahashi, El Cerrito, both of Calif.

[73] Assignee: Herst Lighting Co., Berkeley, Calif.

[21] Appl. No.: 328,106

[22] Filed: Dec. 7, 1981

[51] Int. Cl.[3] ..... F21S 1/02

[52] U.S. Cl. ..... 362/147; 362/145; 362/219; 362/220; 362/226; 362/249; 362/250; 362/368; 362/370; 362/404; 362/430

[58] Field of Search ..... 362/370, 372, 145, 147, 362/219, 220, 226, 249, 250, 368, 404, 430

[56] References Cited

U.S. PATENT DOCUMENTS 3,158,327 11/1964 Dameral ..... 362/260

4,109,305 8/1978 Claussen et al. ..... 362/404

4,175,360 11/1979 Mulvey ..... 362/150

4,358,817 11/1982 Bielameier ..... 362/384

*Primary Examiner*—Stephen J. Lechert, Jr.

*Attorney, Agent, or Firm*—Bruce & McCoy

[57] ABSTRACT

An adjustable overhead lighting fixture having fixed elongated support runners, which themselves may or may not be lighting fixtures, and a plurality of elongated hanger fixture elements which endwise releasably engage and span any two support runners at any point along the length of the runners and which are electrified from the runners. Hanger fixture elements may be used to support and electrify other hanger fixture elements such that the fixtures can be arrayed overhead to meet a variety of lighting applications.

21 Claims, 5 Drawing Figures

ADJUSTABLE OVERHEAD LIGHTING SYSTEM

BACKGROUND OF THE INVENTION

The present invention relates to lighting systems generally and more particularly to overhead lighting systems used for illuminating institutional and commercial buildings, such as libraries, museums, art galleries, and retail stores and also for the illumination of interior office environments, such as open plan office areas where desk or task locations may change, and for display and accent lighting. The invention contemplates the use of linear lighting elements in any desired combination of direct and/or indirect lighting configurations to meet most lighting needs. It is also contemplated that the lighting system of the invention will have the extended capacity to serve as the structural support system for room wall partitions or for an overhead T-bar grid ceiling, or both whereby the lighting elements become an integral part of the interior construction of spacial environments.

Overhead lighting systems comprised of elongated fluorescent luminaires have long been in commercial buildings and offices to provide either direct or indirect lighting, or both. Such a system is illustrated in U.S. Pat. No. 3,158,327 to C. R. Dameral which discloses an overhead system wherein the fluorescent lighting fixtures are mechanically joined to, and project perpendicularly from, a central elongated overhead ballast housing. Like other conventional overhead lighting systems, the lighting elements of Dameral are fixed and the system non-adjustable once installed and require a separated ballast housing; the system is designed for permanent installation and must be removed and replaced by a different lighting system if different light distributions are desired.

Because in office, commercial, and institutional environments lighting requirements often change from time to time, a more flexible lighting system would be desirable, not only one which can be more easily installed and which can be configured on site, but one which can be readily changed on site, using the same parts, as lighting requirements change.

The present invention provides a lighting system which once installed is completely and readily adjustable. Individual lighting elements have no fixed mechanical connections and can be adjustably arranged overhead in an adjustable gridlike array to permit the same basic lighting system and parts to be readily adapted to a wide variety of different lighting needs and to changing needs. In the adjustable lighting system of the invention lighting elements can be releasably engaged to other linear elements of the system anywhere along the length of the other linear elements, and can be electrified from any point within the system.

It is therefore a primary object of the present invention to provide overhead lighting with linear lighting elements which can be easily assembled and arrayed into a practically infinite number of different grid lighting systems tailored to the user's lighting needs. It is also an object to provide an adjustable overhead system which can support other structural elements, such as wall partitions or structures from which a totally integrated grid ceiling can be constructed. Other objects of the invention will be apparent from the following specification and claims.

SUMMARY OF THE INVENTION

The present invention is an adjustable overhead lighting system comprised of a set of elongated support runners suspended overhead by suitable suspension means and a plurality of hanger fixture elements which endwise releasably engage and span any two adjacent support runners at any point along the length of the runners. End cap means project from each end of the hanger fixture elements for releasably engaging the sides of the support runners and the support runners are provided with electrical source means along the length thereof from which the lamps in the hanger fixture elements can be electrified from any location on the runner.

DETAILED DESCRIPTION OF THE PREFERRED EMBODIMENT

Figure 1:
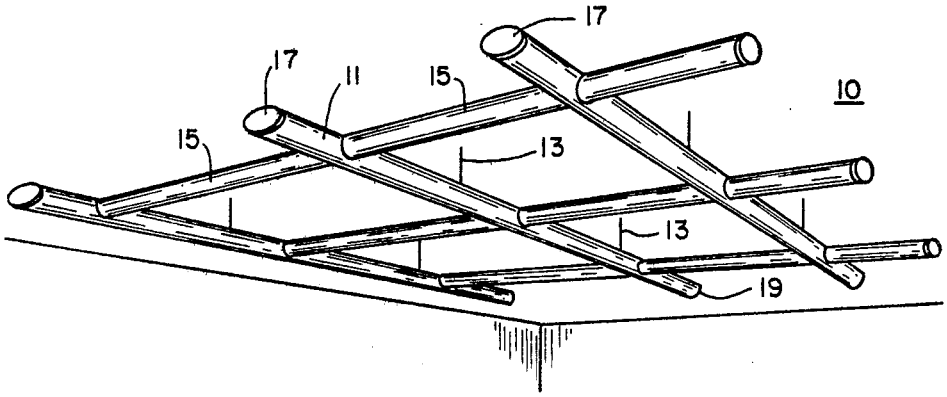
FIG. 1 is a perspective view of an adjustable overhead lighting system showing runners suspended below a ceiling surface, with hanger fixture elements releasably supported between the runners.
Figure 2:
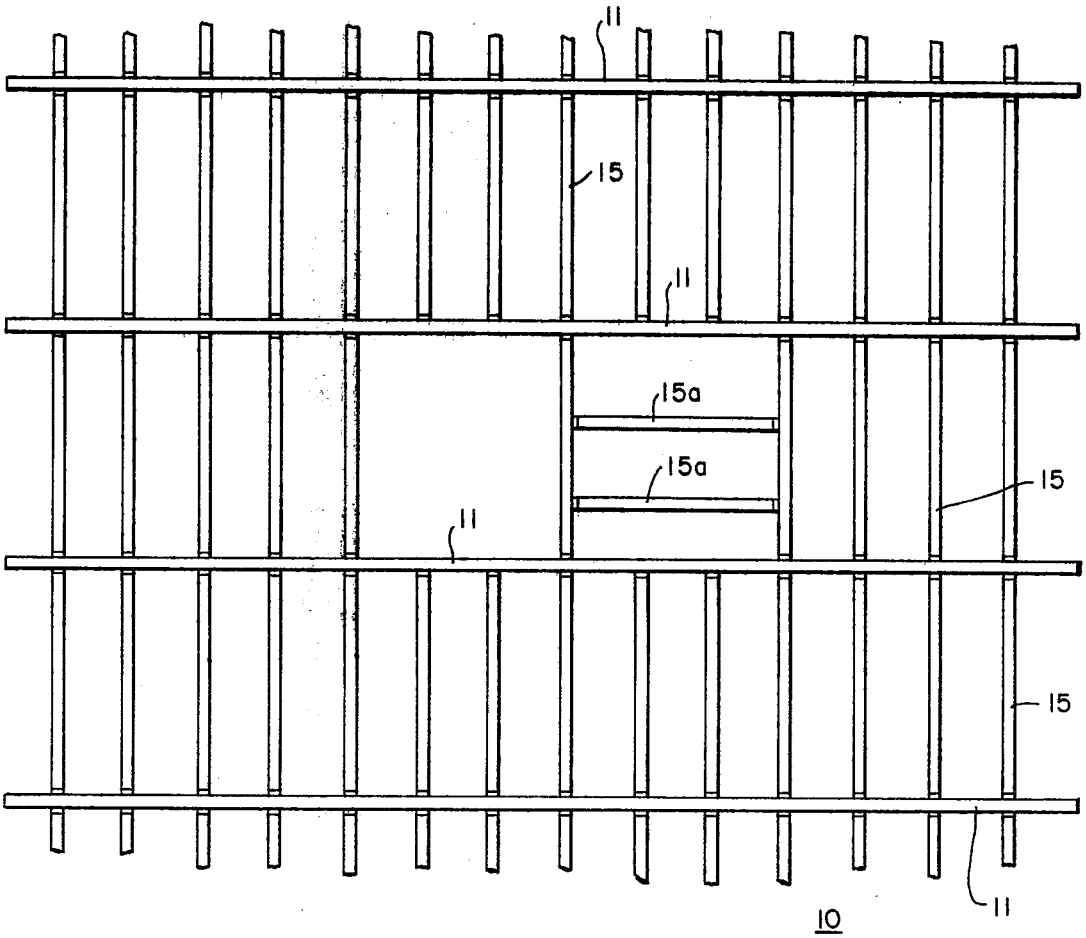
FIG. 2 is a bottom plan view of an adjustable overhead lighting system showing one illustrative array of hanger fixture elements on the support runners.

Referring now to the drawings, FIGS. 1 and 2 illustrate an adjustable lighting system, generally denoted by the number 10, comprised of a set of support runners 11 suspended from an overhead ceiling surface (not shown) by means of hanger rods 13; the support runners are interconnected by hanger fixture elements 15 to form a grid-like lighting system. It will be appreciated that, while the support runners of the system are shown as being suspended from an overhead ceiling, the support runners could be held in their overhead position by other means of suspension. For example, the support runners might be secured at their ends 17, 19 between adjacent wall surfaces or mounted on wall partitions. It will also be appreciated that the hanger fixture elements 15 can be either up or down light sources, or both, for providing indirect or direct lighting or a combination of indirect and direct lighting; any of the hanger fixture elements can be placed in any combination anywhere along the elongated support runners, and electrified therefrom, in order to achieve optimum light distribution for the lighting task involved. It is also noted from FIG. 2 that it is an additional feature in the invention that hanger fixture elements 15*a* can be secured between and electrified from other hanger fixture elements 15 of the lighting element array so as to extend the array. Finally it is noted that, as hereinafter described, the support runners themselves may also be lighting fixtures and that in fact the lamp housing of both the support runners 11 and hanger fixture elements 15 may be fabricated from identical extrusions to provide individual uniformly constructed system elements.

Figure 3:
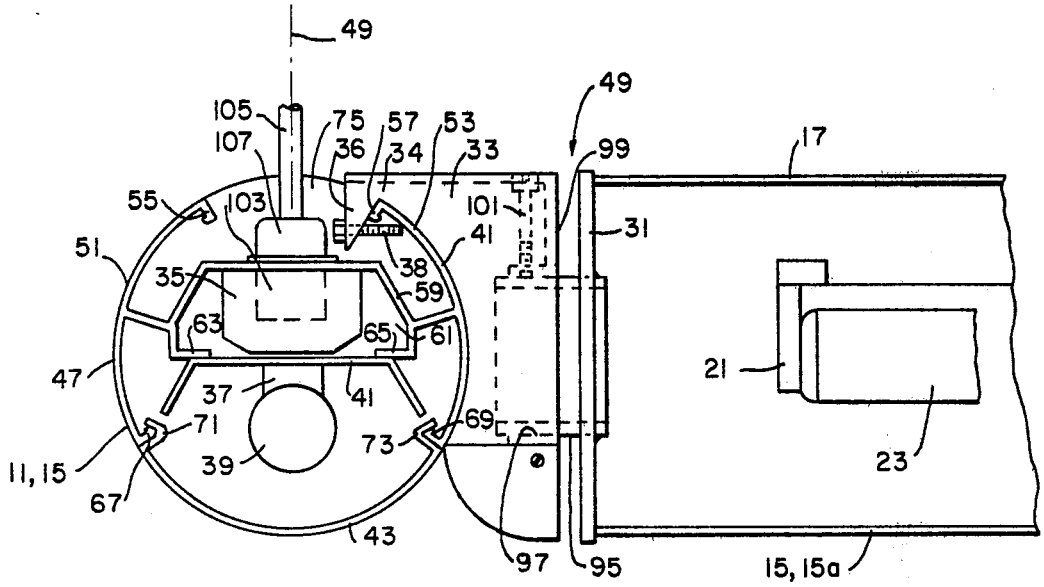
FIG. 3 is a partial cross-sectional view of a support runner and a hanger fixture element showing the hanger fixture element releasably engaged to the side of the runner.
Figure 5:
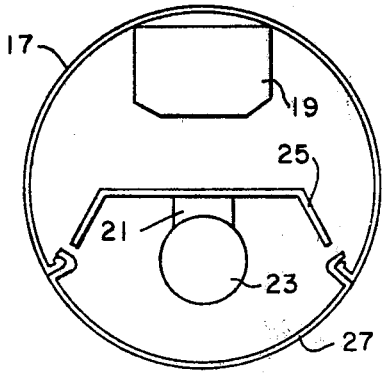
FIG. 5 is a cross-sectional view of the hanger fixture element shown in FIG. 3.

Referring to FIGS. 3 and 5, it is seen that both the support runners and hanger fixture elements are elongated, linear elements having uniform cross-sectional shapes. The hanger fixture element 15 has an elongated lamp housing 17 containing a ballast 19, and lamp sockets 21 for holding fluorescent lamps 23, a reflector plate 25 positioned behind the fluorescent lamps, and a lens 27. The illustrated hanger fixture element is a down light having one fluorescent lamp, however, it will be understood that any hanger fixture element could be comprised of a linear lighting element with any desired optical configuration having any number of lamps, and having any reflector or lens design. And while the illustrated embodiment contemplates the use of fluorescent lamps, other light sources can be used, such as incandescent or HID lamps. The single lamp down light configuration shown in the drawings is for illustration purposes only.

Figure 4:
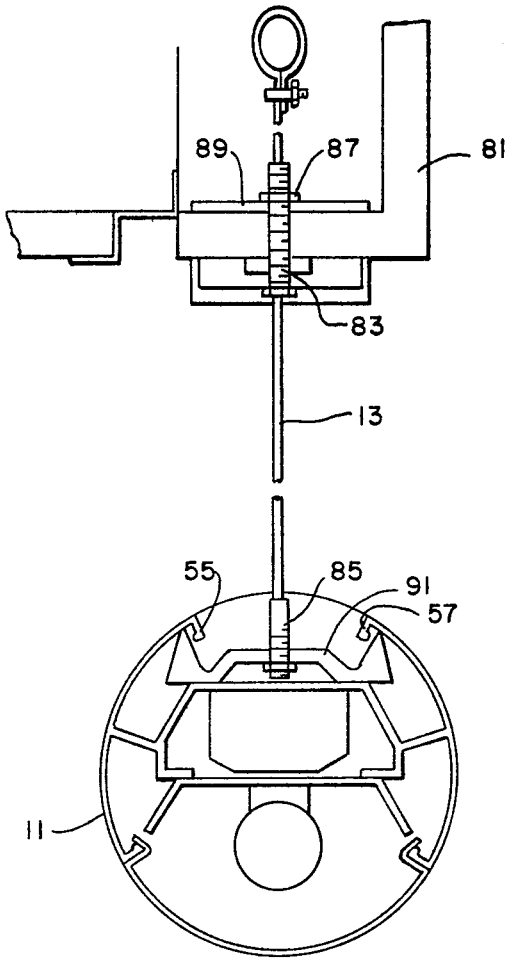
FIG. 4 is a cross-sectional view of the support runner of the system showing the suspension of the runner from an overhead ceiling structure.

Each end of the lamp housing 17 of the hanger fixture elements 15 is capped by an end plate 31 from which there projects an end cap means 33 formed to releasably engage one of the sides of a support runner 11, or one of the sides of another fixture element 15. The preferred construction of the support runner, which will endwise support a hanger fixture element 15 from its end cap 33, is illustrated in FIGS. 3 and 4. The support runners of the FIGS. 3 and 4 are linear lighting fixtures elements in and of themselves and have a separate ballast 35, lamp sockets 37, and lamps 39, with optics provided by reflector plate 41 and lens 43. Like the hanger fixture elements, the support runners can also be configured as an up light as well as the illustrated down light, or can be a combination of an up and down light, and can be provided with different lamp, lens, and reflector combinations.

In the illustrated embodiment the support runner 11 has a lamp housing 47, which is preferably fabricated from an extruded metal material such as aluminum; the lamp housing 47 has a uniform, generally cylindrical, cross-sectional shape over the length of the housing and is symmetrical about a vertical center plane 49 such that it can be engaged from either side by the end cap means 33 of the hanger fixture elements at any point along the length of the runner.

Referring more specifically to the construction of the housing 47 of the support runner 11, opposing side walls 51, 53 project upwardly on either side of the vertical center plane 49 of the runner to form opposed upper support rims 55, 57 which extend substantially the length of the runner housing 47. The side walls 51, 53 are connected by an internal rib structure 59 which forms a channel 61 for holding the ballast 35. Reflector 41 is mounted to tab 63, 65 at the bottom of channel 61, and the lens, in turn, is snapped onto the bottoms of the opposing side walls 51, 53, which have internally projecting ridges 67, 69 to receive the deformable snap rims 71, 73 formed along the lateral edges of the lens. It is noted that, in addition to housing the ballast and supporting the lens, channel 61 will also serve as a conduit for electrical wiring (not shown) to and from the ballast and lamp sockets.

The opposing support rims 55, 57, which define a top channel opening 75 in the runner housing 47, support an upper laterally projecting portion 34 of the hanger fixture elements end cap means 33. A locking ridge 36 projects downwardly from the end of the upper laterally projecting portion of the end cap means for hooking over the upper support rim 55, 57 of the runner housing 47, in a manner which locks the end cap, and in turn the hanger fixture element, to the side of the runner. A locking screw 38 can additionally be provided to prevent any inadvertent upward force from dislodging the end cap from the side of the runner.

It can be seen that the opposing side walls of adjacent support runners will act to brace the hanger fixture elements 15 by contacting the outwardly facing bracing surface 41 of the end cap, which extends downwardly from the end cap's upper laterally projecting portion 34. The end cap bracing surface 41 is formed to lay substantially flush against the runner's side wall to provide a firm, supportive contact between the runner and the hanger fixture element.

Referring to FIG. 4, a suitable means is shown for suspending the support runners from an overhead structure such as a overhead beam 81. Suspension rods 13 having threaded ends 83, 85 can be secured to the beam 81 by means of a suitable nut and washer, 87, 89, and to the support runner through a laterally extending mounting bracket 91, which locks under the housing support rims 55, 57. The number and spacing of hangers would be determined by the length of the runners and the anticipated load of the fully assembled adjustable lighting systems.

Adjustment means are provided for extending the end cap means 33 from the end plate 31 of the hanger fixture element housing 17 to provide for an adjustment in the length of the hanger fixture element to permit the elements to be precisely fitted between two adjacent support runners. The end cap adjustment means includes an axially projecting support sleeve 95 secured to the end plate 31 of the lamp housing 17; the sleeve fits into a sleeve opening 97 formed in the back plate 99 of the end cap means whereby the end cap means can be axially adjusted on the sleeve and can be locked into its adjusted position by means of set screws, such as the illustrated set screw 101.

It is noted that in FIG. 5 the lamp housing 17 of the hanger fixture element 15 is illustrated to be a simple fully enclosed cylindrical housing, which differs in cross-sectional shape from the lamp housing configuration of the support runners. However, as previously discussed, the lamp housing of the hanger fixture element can have a design substantially identical to the support runners, that is, it can also be provided with a top opening and upper support rims to receive the end cap means of other hanger fixture elements. With such a construction the hanger fixture elements of the adjustable lighting system can be arrayed across other hanger fixture elements as well as between support runners.

As to electrifying the support runners and movable hanger fixture elements of the system, the support runners 11 include electrical source means which, in the illustrated embodiment of the invention, includes a series of electrical sockets 103 distributed along the length of the support runner. The electrical path means of each of the hanger fixtures will correspondingly be comprised of a suitable electrical cord 105, terminated by an electrical plug 107, of sufficient length to reach and be plugged into the electrical receptical which is closest to the hanger fixture element. The electrical recepticals 103, as well as the ballast 35 of the support runners can be wired through the housing channel 61 to a suitable external power source, typically 120 volt house wiring. It is contemplated that every support runner will be electrified such that the hanger fixture elements will always contact an electrified runner. From the description herein any skilled technician could wire the support runner and hanger fixture elements to provide complete electrical circuits between the lamp sockets 21, 37 and the power sources.

It will be understood that hanger fixture elements designed like support runners so as to releasably support other hanger fixture elements (such as the hanger fixture elements 15*a* in FIG. 2) will likewise have electrical path means consisting of further electrical recepticals (not shown) wired along the hanger fixture element in the same manner as the recepticals 103 are wired along the support runners, except that the hanger fixture element recepticals would be wired from the fixture elements electrical power cord 105, instead of from house wiring.

It will be further understood that the above-described electrical source and path means for electrifying the lamps in the hanger fixture elements is illustrative and that the invention is not intended to be limited to this means of distributing electrical power along the runners and individual hanger elements. For example, it is contemplated that the electrical source and path means might be comprised of continuous conducting tracks which extend the length of the runners in a suitable position, such as beneath the support rims 55, 57, where the conducting tracks can be contacted by corresponding electrical contacts disposed in the end cap 33, when the end cap is placed over the side wall of the support runner (or likewise over the lamp housing of another hanger fixture element which has conducting tracks). In this manner, hanger fixture elements would be electrified automatically once they are placed into position on the support runners, without the need for electrical cords.

Therefore, it is seen that the present invention provides a completely adjustable overhead lighting system comprised of linear lighting elements which can be easily configured into a wide variety of overhead arrays of lighting elements. With the lighting system of the present invention, a lighting system element of a basic, uniform design can be employed to assemble lighting systems to meet a wide variety of overhead lighting needs; and once in place, the resulting system can be readily changed as dictated by changing lighting needs. To install the lighting system of the invention it is only necessary to install the basic support runners, and from there to array the hanger fixture elements in any desired configuration.

Although the present invention is described in considerable detail in the foregoing specification, it is not intended that the invention be limited to the foregoing description, nor to the details used in describing the illustrated embodiment of the invention, except as necessitated by the following claims.

What we claim is:

1. An adjustable overhead lighting system comprising a set of elongated support runners of a uniform cross-sectional shape suspended overhead in spaced parallel relation with other support runners, said set of support runners having electrical source means, a plurality of elongated hanger fixture elements, each hanger fixture element having an elongated lamp housing and end cap means projecting from the ends of said lamp housing, said end cap means being formed to releasably endwise engage the sides of said support runners along the length thereof whereby said hanger fixture element can be supported between adjacent parallel support runners substantially anywhere along the length of said support runners, said hanger fixture elements having electrical means including electrical path means for electrifying the lamps in said hanger fixture element lamp housing from the electrical source means of said support runners, when said hanger fixture elements are positioned on said support runners.

2. The adjustable overhead lighting system of claim 1 wherein said hanger fixture elements include hanger fixture elements having a cross-sectional shape substantially identical to the cross-sectional shape of said support runners whereby said hanger fixture elements can be supported between other adjacent hanger fixture elements, in addition to being supported between adjacent support runners thereby extending the adjustable array of lighting elements in said system, and wherein said hanger fixture elements have electrical path means for electrifying lamps in the lamp housing thereof from the electrical source means of said source means of said support runners through other intermediate hanger fixture elements.

3. The adjustable overhead lighting system of claim 1 or 2 wherein said support runners form lamp housings and have means for electrifying the lamps therein from said electrical source means, whereby said runners, in addition to the hanger fixture elements supported by said runners, serve as a linear source of light.

4. An adjustable overhead lighting system comprising a set of elongated support runners having opposite side walls projecting upwardly on either side and the vertical center plane of said runners to form opposed upper support rims which extend substantially the length of said runners, said support runners being horizontally suspended overhead in spaced parallel relation to one another and having electrical source means along the length thereof, a plurality of hanger fixture elements, each of said hanger fixture elements being comprised of an elongated lamp housing of a length to span said spaced apart support runners and including an end cap means at each end of said housing, said end cap means having a laterally projecting portion formed to releasably engage the upper rim of one of the side walls of any one of said support runners whereby said hanger fixture element can be supported between adjacent support runners on the adjacent sidewalls thereof anywhere along the length of said runners, each of said hanger fixture elements having means including electrical path means for electrifying the lamps in the lamp housings thereof from the electrical source means of the support runners.

5. The adjustable overhead lighting system of claim 1 or 4 wherein said hanger fixture's elements include adjustment means for adjusting the length thereof whereby said hanger fixture elements can be precisely fitted between adjacent support runners.

6. The adjustable overhead lighting system of claim 5 wherein said adjustment means includes means for adjusting the axial position of said end cap means with respect to the lamp housing of said hanger fixture element.

7. The adjustable overhead lighting system of claim 6 wherein the lamp housing of said hanger fixture element has end plates and wherein said end cap adjustment means includes an axially projecting support sleeve secured to said lamp housing end plates and a corresponding sleeve opening in said end cap means formed such that the end cap means is slidably adjustable along said projecting support sleeve.

8. The adjustable overhead lighting system of claim 4 wherein said end cap means includes an outwardly facing bracing surface extending downwardly from the laterally projecting portion thereof, said bracing surface being formed such that the opposite end cap means of a hanger fixture element will mate substantially flush against the sidewalls of adjacent runners.

9. The adjustable overhead lighting system of claim 4 wherein the side walls of said support runners are arcuate in shape and wherein the end cap means of said hanger fixture elements have a correspondingly arcuate outwardly facing bracing surface.

10. The adjustable overhead lighting system of claim 9 wherein the upper end of the arcuate bracing surface of said end cap means terminates in a downwardly projecting locking ridge formed at the end of the laterally projecting portion of said end cap means whereby the end cap means of said hanger fixture element, when braced against the side wall of said runner of any position therealong, will removably lock into position on said runner.

11. The adjustable overhead lighting systems of claim 4 wherein said support runners and hanger fixture elements are fabricated of a metal extrusion.

12. The adjustable overhead lighting system of claim 4 wherein said support runners form lamp housings and have means including electrical path means for electrifying lamps therein from said electrical source means, wherein said support runners, in addition to the hanger fixture elements supported by said runners, serve as a source of light.

13. An adjustable overhead lighting system comprising, a set of elongated support runners of uniform cross-section, each of said support runners having opposite arcuate side walls projecting upwardly on either side of the vertical center plane of said support runners to form opposed upper support rims which extend substantially the length of said runners, said support runners being horizontally suspended overhead in spaced parallel relation to another and having electrical source means along the length thereof, a plurality of hanger fixture elements, each of said hanger fixture elements being comprised of an elongated lamp housing of a length to approximately span the space between adjacent support runners, and each of said hanger fixture elements including an end cap means at each end of said housing, adjustment means for adjusting the axial position of said end cap means with respect to said lamp housing of said hanger fixture element, said end cap means having a laterally projecting portion formed to releasably engage the upper rim of one of the side walls of any one of said support runners and further having an outwardly facing arcuate bracing surface extending downwardly from the laterally projecting portion thereof such that said bracing surface of said end cap means will mate substantially flush against the arcuate side walls of a support runner, the upper end of said arcuate bracing surface of said end cap means terminating in a downwardly projecting locking ridge formed at the end of the laterally projecting portion of said end cap means whereby the end cap means of said hanger fixture elements, when braced against the side wall of said runner at any position therealong, will removably lock into position on said runner, each of said hanger fixture elements having means including electrical path means for electrifying the lamps in the lamp housing thereof from the electrical source means of the support runners.

14. The adjustable overhead lighting system of claim 4 or 13 wherein said hanger fixture elements include hanger fixture elements having a lamp housing having side walls and upper support rims substantially identical to the side walls and upper support rims of said support runners whereby hanger fixture elements can be supported between other adjacent hanger fixture elements, in addition to being supported between adjacent support runners, and wherein said hanger fixture elements have electrical means including electrical path means for electrifying lamps in said lamp housing from other intermediate hanger fixture elements when said hanger fixture elements are electrified.

15. A hanger fixture element for an adjustable overhead lighting system comprising an elongated lamp housing having a substantially uniform cross-section along the length thereof, and end cap means formed to releasably engage, in perpendicular relation thereto, other hanger fixture elements at any point along the length thereof whereby said hanger fixture elements can be moveably supported between other hanger fixture elements suspended over head in adjacent parallel relation anywhere along the length of said elements.

16. The hanger fixture element of claim 15 wherein the cross-sectional shape of said lamp housing is symmetric about the vertical center line of said fixture wherein the end cap means can releasably engage either side of the lamp housing.

17. The hanger fixture element of claim 15 wherein said hanger fixture element has opposing sidewalls projecting upwardly on either side of the vertical center plane of said runner to form opposed upper support rims which extend substantially the length of said fixture element.

18. The hanger fixture element of claim 17 wherein said end cap means includes a laterally projecting portion formed to releasably engage the upper support rim of one of the said side walls of other hanger fixture elements.

19. The hanger fixture element of claim 17 wherein said end cap means further includes an outwardly facing bracing surface extending downwardly from the laterally projecting portion thereof, said bracing surface being formed such that opposite end cap means of a hanger fixture element will mate substantially flush against the sidewalls of other adjacent hanger fixture elements.

20. The hanger fixture element of claim 18 wherein the bracing surfaces of said end cap means and the side walls of said lamp housing are accurate in shape.

21. The hanger fixture element of claim 19 wherein said lamp housing is fabricated of a metal extrusion.

* * * * *